United States Patent [19]

Winslow et al.

[11] Patent Number: 5,058,684

[45] Date of Patent: Oct. 22, 1991

[54] DRILL PIPE BRIDGE PLUG

[75] Inventors: Donald W. Winslow; David P. Brisco, both of Duncan, Okla.

[73] Assignee: Halliburton Company, Duncan, Okla.

[21] Appl. No.: 647,938

[22] Filed: Jan. 30, 1991

Related U.S. Application Data

[62] Division of Ser. No. 533,307, Jun. 4, 1990.

[51] Int. Cl.[5] ..... E21B 33/13

[52] U.S. Cl. ..... 166/386; 166/387; 175/318

[58] Field of Search ..... 175/38, 71, 72, 205, 175/215, 218, 230, 231, 317, 318; 166/381, 382, 386, 387

[56] References Cited

U.S. PATENT DOCUMENTS

| | | | |
|---|---|---|---|
| 2,799,346 | 7/1957 | Baker et al. | 166/135 |
| 2,806,532 | 9/1957 | Baker et al. | 166/42 |
| 2,904,115 | 9/1959 | Turner | 166/387 |
| 2,946,388 | 7/1960 | Evans | 166/120 |
| 3,189,096 | 6/1965 | Phenix | 166/133 |
| 3,667,557 | 6/1972 | Todd et al. | 175/318 |
| 3,783,942 | 1/1974 | Mott | 175/318 |
| 3,786,864 | 1/1974 | Segelhorst | 175/317 |
| 3,853,177 | 12/1974 | Mott | 175/317 |
| 3,907,046 | 9/1975 | Gaylord | 175/317 |
| 3,941,190 | 3/1976 | Conover | 175/230 |
| 4,108,257 | 8/1978 | Sizer | 175/230 |
| 4,254,836 | 3/1981 | Russell | 175/218 |
| 4,479,544 | 10/1984 | Callihan et al. | 166/387 |
| 4,640,363 | 2/1987 | Taylor | 166/317 |
| 4,693,315 | 9/1987 | Taylor | 166/336 |
| 4,791,992 | 12/1988 | Greenlee et al. | 166/387 |

OTHER PUBLICATIONS

Exhibit A—Brochure of Baker Oil Tools entitled "Baker Completion Systems Special Products", p. 816 (undated but admitted to be prior art).

Exhibit B—Halliburton Services Sales & Service Catalog, No. 43 (1985), pp. 2556-2562.

*Primary Examiner*—Ramon S. Britts

*Assistant Examiner*—Roger J. Schoeppel

*Attorney, Agent, or Firm*—James R. Duzan; L. Wayne Beavers

[57] ABSTRACT

A retrievable bridge plug apparatus, and associated methods, are provided for sealing the bore of a drill pipe string to control a well that is flowing out of control.

10 Claims, 13 Drawing Sheets

DRILL PIPE BRIDGE PLUG

This is a divisional of copending application Ser. No. 07/533,307 filed on June 4, 1990.

BACKGROUND OF THE INVENTION

1. Field Of The Invention

The present invention relates generally to bridge plugs, and more particularly, but not by way of limitation, to a retrievable bridge plug suitable for setting inside the bore of a string of drill pipe to aid in the control of a well that is flowing out of control.

2. Description Of The Prior Art

Bridge plugs are packing devices which are generally used to completely seal the bore of a string of pipe. Most commonly, bridge plugs are utilized to block the bore of a string of casing in a well.

Bridge plugs are typically set by engaging the bore of the pipe string with a set of slips and then mechanically or hydraulically setting a packer against the bore.

During the drilling of a well, a string of drill pipe with the drill bit connected to the lower end thereof extends down into a well bore and is rotated to extend the depth of the well bore.

If the drilling operator loses control of the fluids in the well bore, i.e., a blowout occurs, the well will initially be brought under control by shearing the drill pipe near the surface with the shear rams, and removing the upper portion of drill pipe and closing in the well above the sheared off upper end of the drill pipe. Well fluids may continue to flow upward through the drill pipe and through the well bore, which outward flow up through the well is controlled through the choke line.

In order to bring the well back under control, it is necessary at some point to remove the damaged upper portion of the drill pipe and reconnect new drill pipe segments thereto.

Accordingly, it is desirable to have a bridge plug which could be set in drill pipe to stop the flow up through the drill pipe so that the damaged upper portions of the drill pipe could be removed and replaced with new drill pipe segments.

SUMMARY OF THE INVENTION

The present invention provides such a bridge plug apparatus for sealing off the bore of a damaged string of drill pipe, and also provides related methods for controlling well flow.

A retrievable bridge plug apparatus in accordance with the present invention includes a packer mandrel assembly having a longitudinal mandrel bore defined therein with a barrier blocking the mandrel bore. The packer mandrel assembly has a bypass port disposed radially through a wall thereof and communicated with the mandrel bore below the barrier.

A packer is disposed on the packer mandrel assembly for sealing between the packer mandrel assembly and the bore of the drill pipe string below the bypass port upon engagement of the packer with an internal upset of the drill pipe string and subsequent application of upward force to the packer mandrel assembly.

A bypass sleeve is slidably disposed about the packer mandrel assembly and movable longitudinally relative to the packer mandrel assembly between an open position wherein the bypass port is open and a closed position wherein the bypass port is closed. The bypass sleeve is fixed against rotational movement relative to the packer mandrel assembly.

A rotating case assembly is operably associated with the packer mandrel assembly and bypass sleeve. The case assembly is threadedly engaged with the bypass sleeve so that upon rotation of the rotating case assembly relative to the packer mandrel assembly the bypass sleeve is selectively moved between its opened and closed positions.

A thrust bearing is provided between the packer mandrel assembly and the rotating case assembly for permitting rotation of the rotating case assembly relative to the packer mandrel assembly while simultaneously applying a sufficient upward force on the packer mandrel assembly from the rotating case assembly to maintain the packer sealed against the drill pipe bore.

The barrier and bypass port in the packer mandrel assembly, the bypass sleeve, the rotating case assembly, and the thrust bearing means can be collectively defined as a selectively positionable bypass means of the bridge plug apparatus. The bypass means performs several functions. It prevents fillup of the work string to which the bridge plug apparatus is attached as the work string and the bridge plug apparatus are run into position in the drill pipe string. Further, the bypass means communicates the pipe bore below the packer with a low pressure zone above the packer through the mandrel bore prior to sealing the packer against the drill pipe bore. Further, the bypass means isolates the pipe bore below the packer from the low pressure zone above the packer after the packer is sealed against the drill pipe bore. Finally, the bypass means serves to recommunicate the drill pipe bore below the packer with the low pressure zone above the packer through the mandrel bore to balance pressure across the packer prior to unsetting of the packer and retrieval of the bridge plug apparatus.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
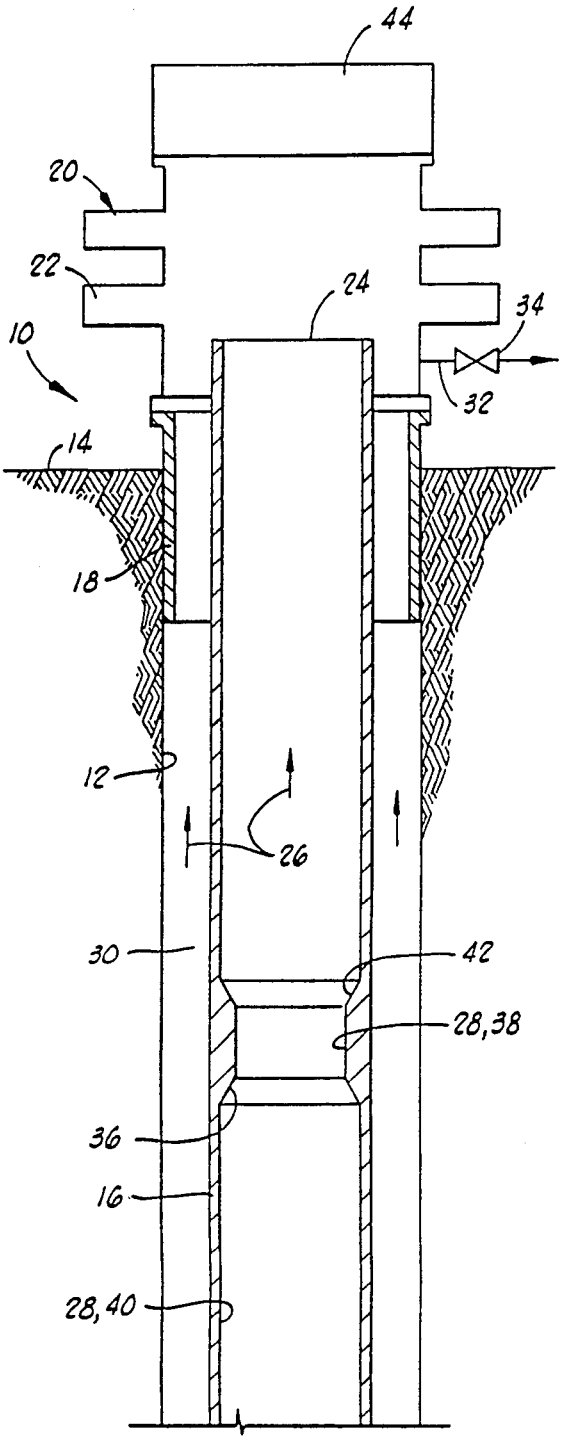
FIG. 1 is a schematic illustration of a string of drill pipe in a well, bore hole after the upper end of the drill pipe has been sheared by the shear rams.
Figure 2:
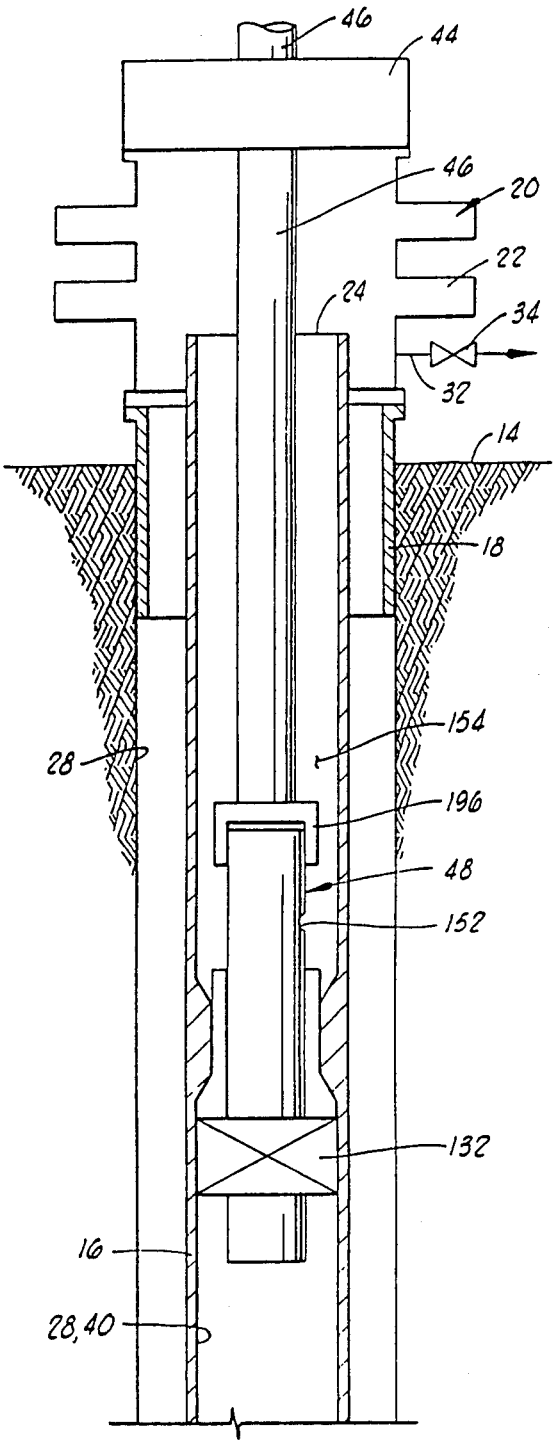
FIG. 2 is a schematic illustration similar to FIG. 1 showing the bridge plug apparatus of the present invention having been lowered into the drill pipe string on a snubbing unit work string and having been set in place within the drill pipe string to seal across the bore of the drill pipe.

Referring now to the drawings, and particularly to FIGS. 1 and 2, the general structure of an oil well is there schematically illustrated, along with the placement of the drill pipe bridge plug apparatus of the present invention within such a well to control the flow of fluid up through the drill pipe.

In FIG. 1, a typical oil or gas well 10 is schematically illustrated. A well bore 12 has been drilled down through the earth's surface 14 by a drill bit (not shown) located on the lower end of a string of drill pipe 16. A length of surface casing 18 has been set in the bore hole 12.

A blowout preventer stack 20 is mounted on the surface casing 18. In FIG. 1, the shear rams 22 of the blowout preventer stack 2 have been used to shear off the drill pipe string 16 thus creating a damaged upper end 24 of the drill pipe string 16.

Well fluids are schematically illustrated by the arrows such as 26 flowing upward through the pipe bore 28 of drill pipe string 16 and through the annulus 30 defined between well bore 12 and drill pipe string 16. The flow of these upwardly flowing fluids is permitted by the choke line 32 having valve means 34 therein through which the flow can be controlled.

Figure 7:
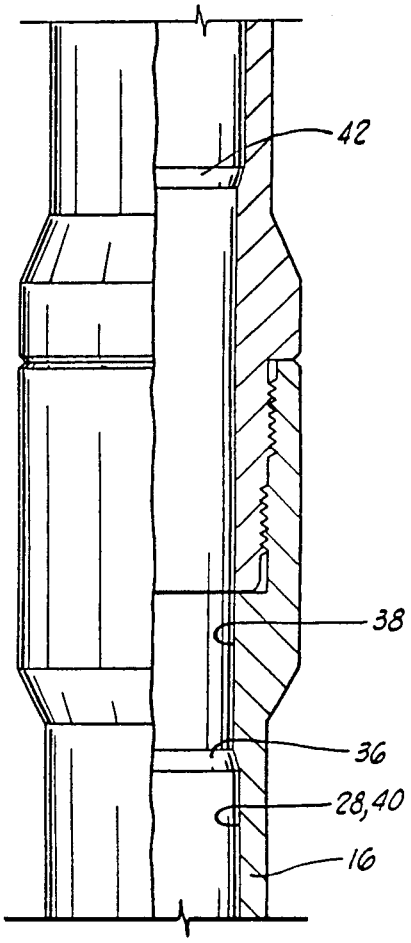
FIG. 7 is an elevation sectioned view of a typical joint between segments of drill pipe illustrating more precisely the typical configuration of the internal upset within the drill pipe bore.

Schematically illustrated in FIG. 1 is a typical internal upset 36 of the pipe bore 28. The true configuration of such an upset is best seen in FIG. 7 which illustrates a connection between two joints of a typical form of drill pipe utilized in the oil field. The joint illustrated in FIG. 7 is a Hydril PH-4 TM drill pipe. As is apparent in FIG. 7, near the ends of each drill pipe segment the pipe wall has an increased thickness thus defining a minimum diameter pipe bore 38 adjacent the joint, with an enlarged diameter drill pipe bore 40 throughout most of the length of each joint, and with tapered transitional shoulders such as 36 and 42 at the lower and upper ends of the reduced diameter bore 38. It is the lower transitional shoulder 36 which is utilized for purposes of the present invention as an internal upset of the pipe bore 28 against which a bridge plug can be set.

Although the internal upset 36 illustrated in FIG. 7 is integrally formed on one of the sections of drill pipe, it will be understood that the term internal upset can generally be used to describe any downwardly facing surface defined internally within the pipe string which could be used to engage a structure like the collet of drill pipe bridge plug apparatus 48 further described below.

A snubbing unit 44 is schematically illustrated as being mounted above the blowout preventer stack 20. As seen in FIG. 2, a snubbing unit work string 46 having the bridge plug apparatus 48 of the present invention connected to a lower end thereof has been lowered through the snubbing unit 44 into the drill pipe bore 28. The bridge plug apparatus 48 has been set within the drill pipe bore 28 and against the internal upset 36 thereof to seal the pipe bore 28. The snubbing unit 44 permits the snubbing unit work string 46 to be lowered therethrough while maintaining a seal about the work string 46 so that any upward flow of fluids is still controlled by the choke line 32 and valve means 34.

Turning now to FIGS. 3A–3J, the details of construction of a preferred embodiment of the drill pipe bridge plug apparatus 48 will be described.

The bridge plug apparatus 48 includes a packer mandrel assembly 50 (see FIGS. 3C–3J) having a longitudinal mandrel bore 52 defined therein with a barrier 54 (see FIG. 3E) blocking the mandrel bore 52. The packer mandrel assembly 50 has a bypass port 56 disposed radially through a wall 58 thereof and communicated with the mandrel bore 52 below the barrier 54.

The packer mandrel assembly 50 includes a number of components fixedly connected together. Beginning at the upper end of packer mandrel assembly 50 in FIG. 3C, the assembly 50 includes a differential piston 60, an upper mandrel 62, a bypass body 64, a packer mandrel 66, a connector 68, and a bottom guide 70.

The differential piston 60 and upper mandrel 62 are threadedly connected at 72 (see FIG. 3C) with a seal 74 therebetween, and with a set screw 76 for locking the threaded connection 72 The differential piston 60 carries an outer 0-ring seal 61 which sealingly engages the rotating case assembly as is further described below.

The upper mandrel 62 and bypass body 64 are threadedly connected at 78 (see FIG. 3E) with the set screw 80 locking the same.

A bypass seal assembly 82 is carried by bypass body 64 and held in place between the lower end 84 of upper mandrel 62 and an upward facing shoulder 86 of bypass body 64. An O-ring seal 88 seals between the bypass body 64 and the bypass seal assembly 82.

The bypass port 56 is disposed through the wall 58 of bypass body 64 just below the bypass seal assembly 82.

The bypass body 64 carries an outer 0-ring seal 90 below bypass port 56 for sealingly engaging the bypass sleeve as is further described below.

Figure 3A:
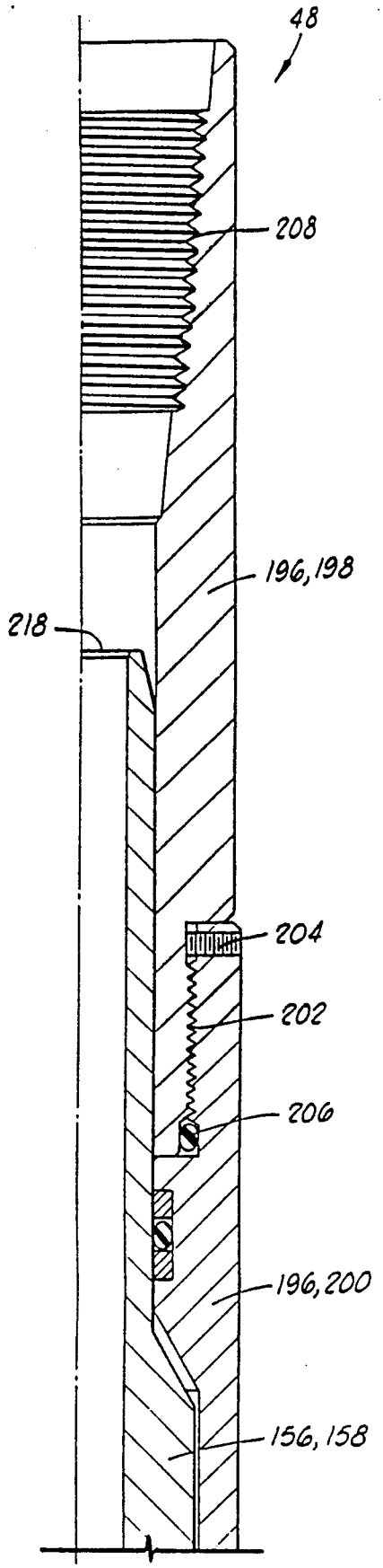
FIGS. 3A–3J comprise an elevation right side sectioned view of a first embodiment of the bridge plug apparatus of the present invention. The apparatus is illustrated in a position prior to expansion of the packer and with the bypass port in an open position. The bypass means of the bridge plug is shown in its open position and is constructed to bypass into the annulus between the snubbing unit work string and the drill pipe bore.
Figure 3B:
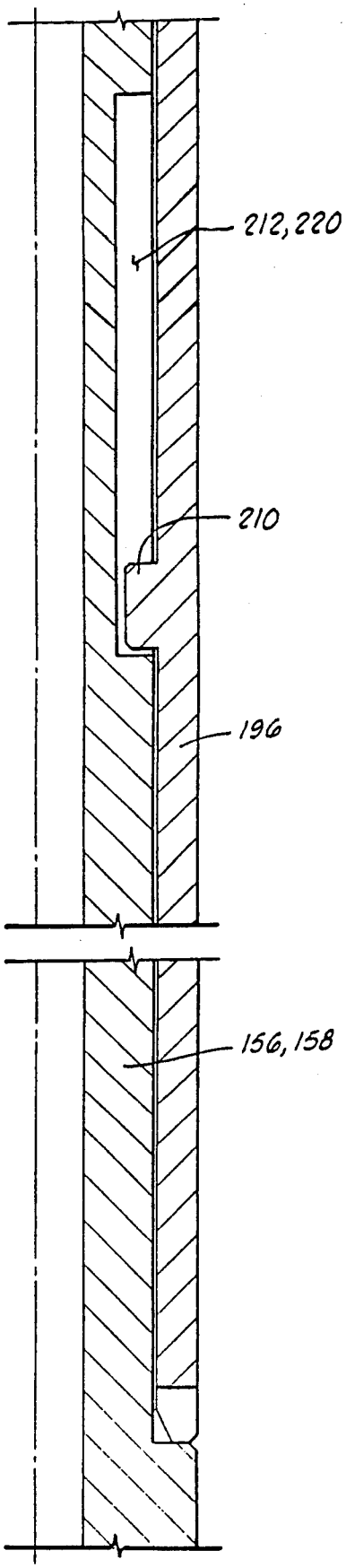
Figure 3C:
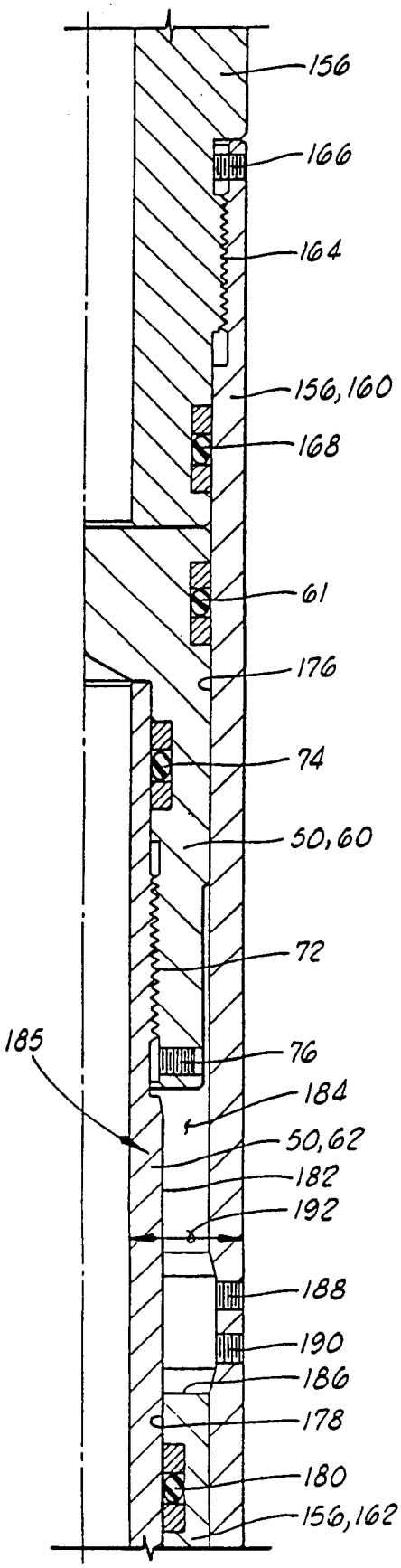
Figure 3D:
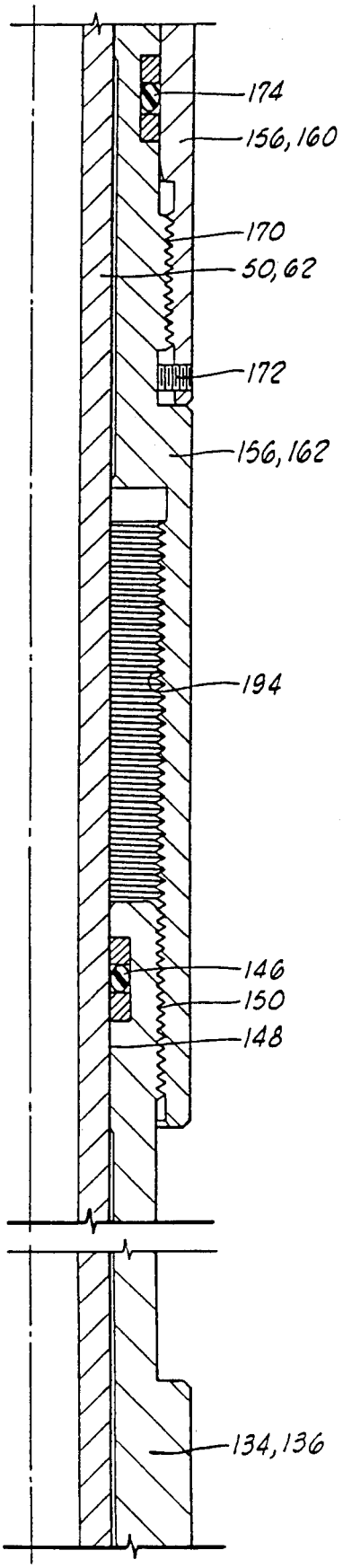
Figure 3E:
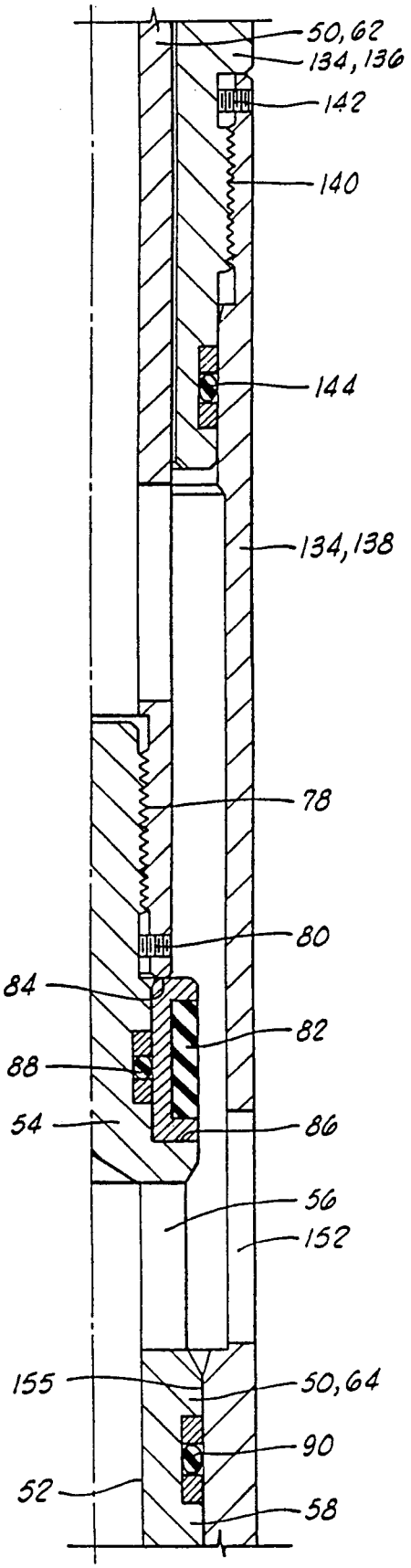
Figure 3F:
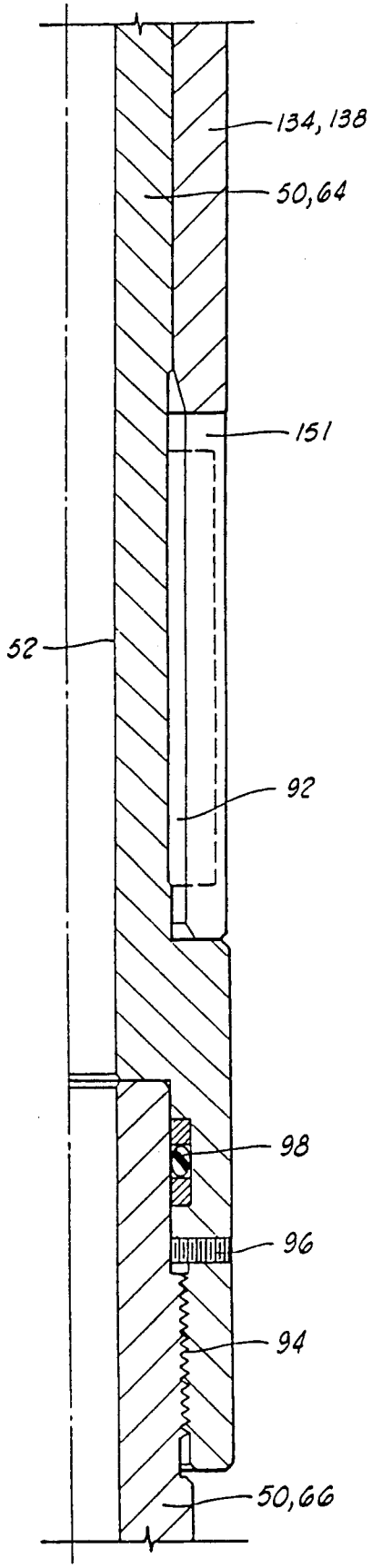

In FIG. 3F, the bypass body 64 is seen to have a plurality of outwardly extending longitudinal splines 92 for engagement with the bypass sleeve as is further described below.

Bypass body 64 is threadedly connected to packer mandrel 66 at 94 with a set screw 96 locking the same and with an O-ring seal 98 therebetween.

The packer mandrel 66 is threadedly connected to connector 68 at thread 100 (see FIG. 3J) with an 0-ring seal 102 being provided therebetween. Connector 68 is threadedly connected to bottom guide 70 at 104 with an 0-ring seal 106 being provided therebetween.

A packer means generally designated by the numeral 108 is disposed on the packer mandrel 66 of packer mandrel assembly 5 for sealing between the packer mandrel 66 and the drill pipe bore 28 upon engagement of the packer means 108 with the internal upset 36 of the drill pipe string 16 and subsequent application of upward force to the packer mandrel assembly 50.

Figure 3G:
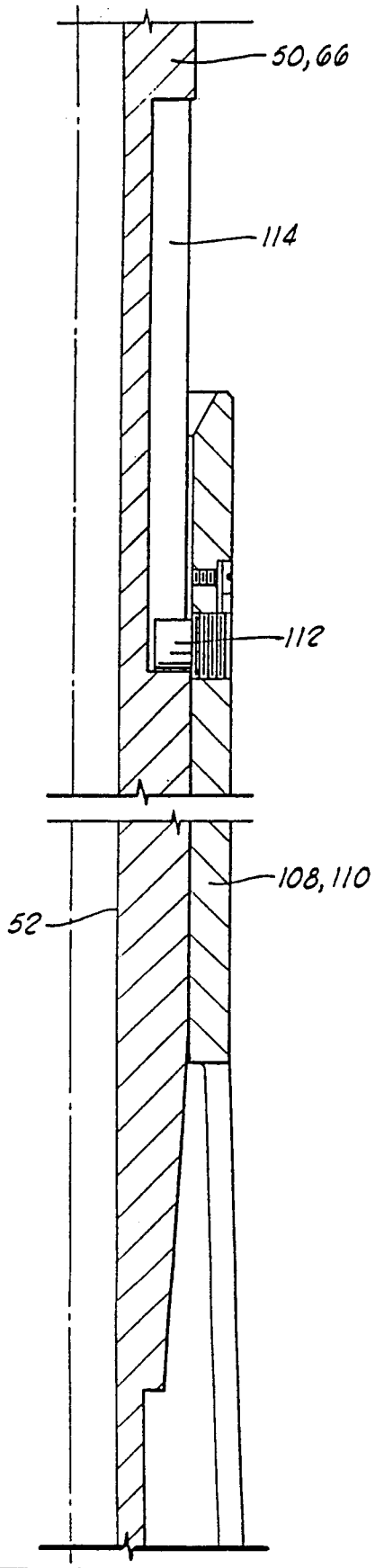
Figure 3H:
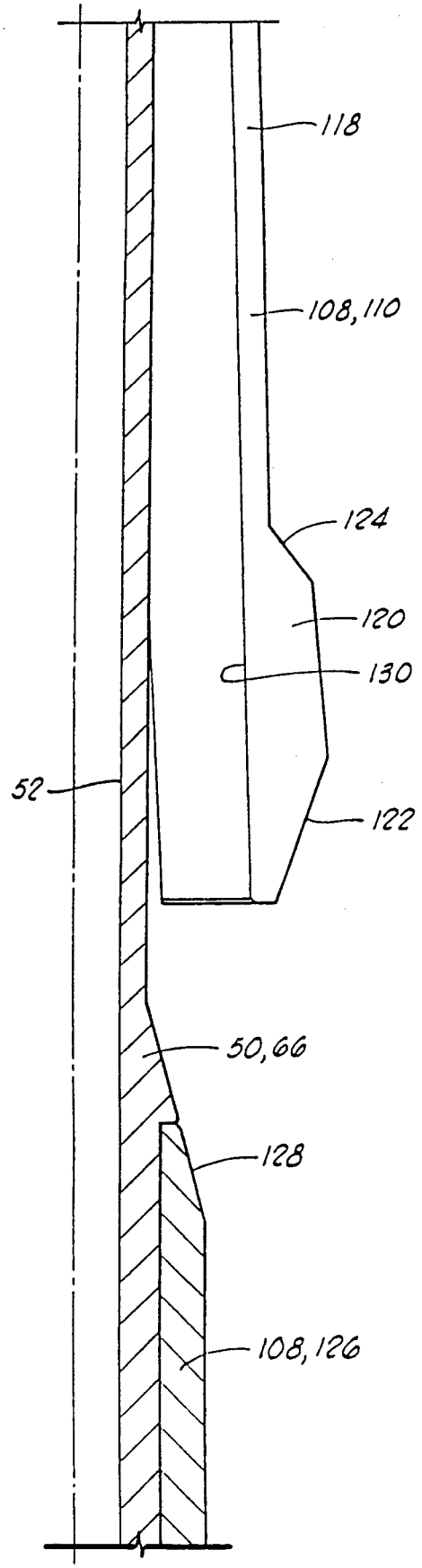
Figure 3I:
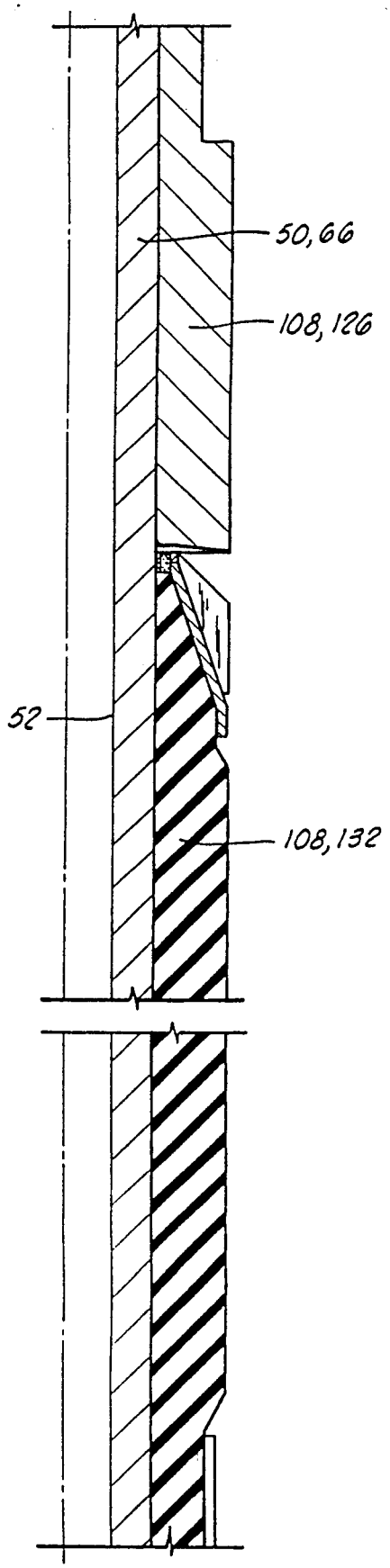
Figure 3J:
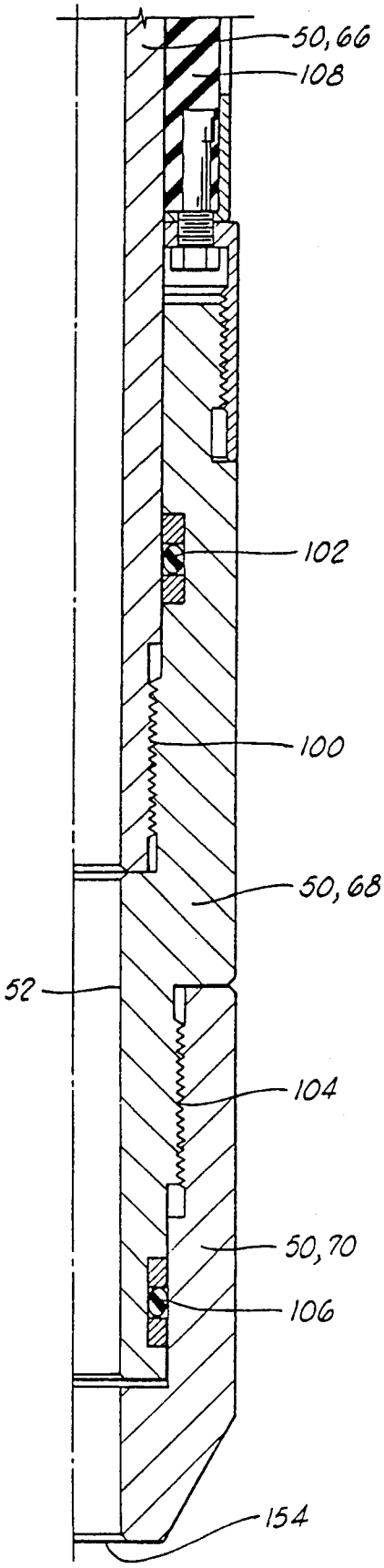
Figure 5:
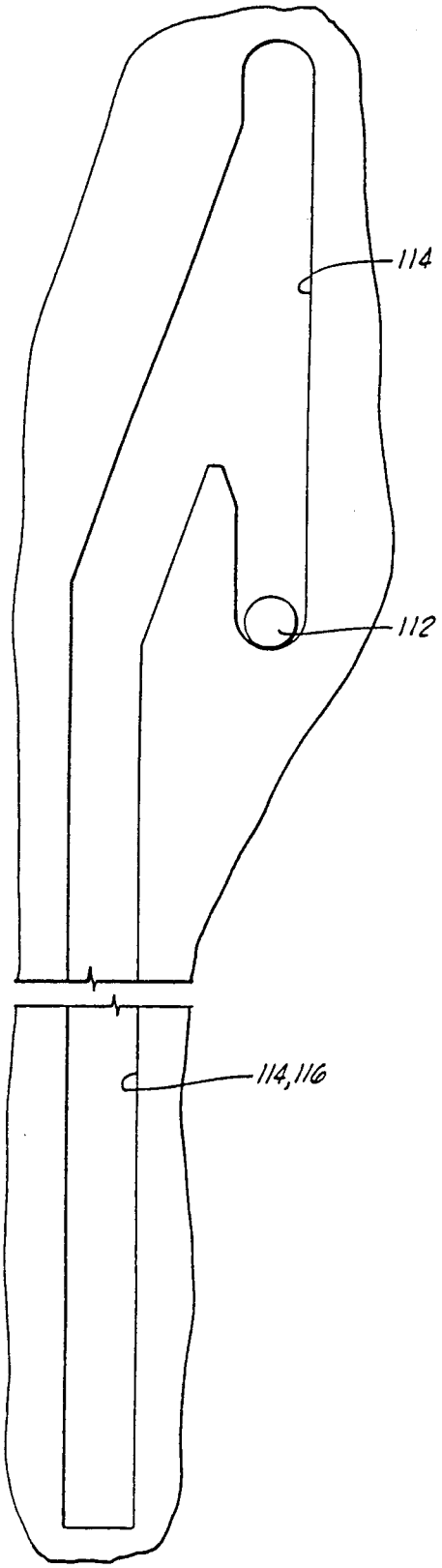
FIG. 5 is a laid out view of the lower J-slot of FIG. 3G which interconnects the collet with the packer mandrel assembly.

The packer means 108 includes a spring collet 110 (see FIGS. 3G–3H) slidably disposed about packer mandrel 66. Collet 110 includes a radially inward extending lug 112 received in a J-slot 114 defined in the outer surface of packer mandrel 66. The lug 112 and J-slot 114 are best illustrated in the laid out view of FIG. 5. In FIGS. 3G and 5, the lug 112 is illustrated in a first position wherein it defines an upper position of the collet 110 relative to the packer mandrel 66. As is best apparent in FIG. 5, downward movement of the packer mandrel 66 relative to collet 110 with subsequent counterclockwise rotation (as viewed from above) of packer mandrel 66 followed by picking up of packer mandrel 66 will move the lug 112 into a longer leg 116 of J-slot 114 thus allowing the collet 110 to move to a lower position thereof relative to the packer mandrel 66.

The collet 110 includes plurality of generally downwardly extending arms 118 each having an enlarged head 120 defined on the lower end thereof. The head 120 includes a downward facing tapered surface 122 which will cam the arms 118 inward to allow the collet 110 to be pulled downward through reduced diameter portions such as 38 (see FIG. 7) of the pipe bore 28. The heads 120 each also include upward facing tapered engagement shoulders 124 for engaging the internal upset 36 (see FIGS. 1, 2 and 7) of the drill pipe string 16.

The packer means 108 also includes an annular anchoring wedge mean 126 slidably disposed about the packer mandrel 66 below the collet 110. Anchoring wedge 126 includes an upward facing tapered wedging surface 128 which is engaged by the inside surface 130 of collet arms 118 when the collet 110 drops to its lower position relative to packer mandrel 66. The engagement of anchoring wedge 126 with the collet arms 118 prevents radially inward compression of the arms 118 of collet 110 when the collet 110 is in its said lower position, thus holding the upper engagement means 124 of the collet arms 118 in a radially expanded position so that it engages the internal upset 36 of drill pipe string 16 when pulled upward thereagainst.

The packer means 108 further includes an expandable sealing element 132 located immediately below anchoring wedge 126. When the collet 110 is allowed to move downward relative to packer mandrel 66 so that it engages the anchoring wedge 126, an upward pull applied to the packer mandrel assembly 50 pulls the engaging shoulders 124 into engagement with the internal upset 36 of drill pipe string 16, and the further application of a sufficient upward pull on the work string 46 and the packer mandrel assembly 50 causes the anchoring wedge 126 to slide downward relative to packer mandrel 66 thus compressing the sealing element 132 between anchoring wedge 126 and the connector 68 of packer mandrel assembly 50 so that the sealing element 132 is caused to expand radially outward as schematically illustrated in FIG. 2 thus sealing against the larger diameter portion 40 of drill pipe bore 28.

The bridge plug apparatus 48 further includes a bypass sleeve assembly 134 (see FIGS. 3D–3F) slidably disposed about the packer mandrel assembly 50 and movable longitudinal relative to packer mandrel assembly 50 between an open position as illustrated in FIGS. 3D–3F wherein the bypass port 56 is open, and a closed position wherein the sleeve assembly 134 is moved upward relative to bypass mandrel assembly 50 to close the bypass port 56.

The bypass sleeve assembly 134 includes a bypass sleeve mandrel 136 and a bypass sleeve 138. The bypass sleeve mandrel 136 and bypass sleeve 138 are threadedly connected at connection 140 which is locked by set screws 142 with an O-ring seal 144 being provided therebetween.

Bypass sleeve mandrel 136 carries a internal O-ring seal 146 near its upper end which slidably sealingly engages a cylindrical outer surface 148 of upper mandrel 62 of bypass mandrel assembly 50. The bypass sleeve mandrel 136 has an external threaded surface 150 defined adjacent the upper end thereof for threaded engagement with a rotating case assembly further described below for purposes of causing the bypass sleeve assembly 134 to move upwards and downwards relative to packer mandrel assembly 50 upon rotation of the rotating case assembly.

The bypass sleeve 138 has a plurality of longitudinally downwardly extending fingers 151 at its lower end which are meshed with the splines 92 of bypass body 64 so that the bypass sleeve assembly 134 is fixed against rotational movement relative to the packer mandrel assembly 50.

The bypass sleeve 138 has a sleeve port 152 defined radially therethrough. When the bypass sleeve assembly 134 is in its open position as illustrated in FIG. 3E, the sleeve port 152 communicates the bypass port 56 and thus the mandrel bore 52 of packer mandrel assembly 50 with a annulus 154 (see FIG. 2) between the packer mandrel assembly 50 and the pipe bore 28 of drill pipe string 16. Thus, the pipe bore 28 of drill pipe string 16 below the sealing element 132 of packer means 108 is communicated with the annulus 154 above the sealing element 132 when the bypass sleeve assembly 134 is in its open position. It is noted that in the embodiment of FIGS. 3A–3J, the mandrel bore 52 of packer mandrel assembly 50 has an open lower end 154 (see FIG. 3J) in open communication with the pipe bore 28 of drill pipe string 16 below the sealing element 132 of packer means 108.

When the bypass sleeve assembly 134 is moved upwards relative to packer mandrel assembly 50, in a manner further described below, an inner bore 155 of bypass sleeve 138 will move into sealing engagement with the bypass seal assembly 82 thus closing the bypass port 56.

The bridge plug apparatus 48 also includes a rotating case assembly generally designated by the numeral 156 (see FIGS. 3A–3D). The rotating case assembly 156 includes a retrieving mandrel 158, a case 160, and a threaded mandrel 162.

The retrieving mandrel 158 and case 160 are threadedly connected at connection 164 which is held by set screws 166 with an O-ring seal 168 being provided therebetween. Case 160 is threadedly connected to threaded mandrel 162 at thread 170 which is locked by set screw 172 with an O-ring seal 174 being provided therebetween.

Case 160 has an inner bore 176 within which the O-ring seal 61 of differential piston 60 is slidably received. Threaded mandrel 162 has an inner bore 178 which carries an O-ring seal 180 through which an exterior cylindrical surface 182 of upper mandrel 62 of packer mandrel assembly 50 is slidably received.

A sealed chamber 184 is thus defined radially between upper mandrel 62 and case 160 and longitudinally between differential piston 60 and an upper end 186 of threaded mandrel 162. Particularly, the sealed chamber 184 is sealed by O-ring seals 61, 74, 174 and 180. A pair of filling ports 188 and 190 are defined through case 160 and allow the chamber 184 to be filled with a relatively incompressible liquid such as oil. When the chamber 184 is so filled, it provides a thrust bearing means generally designated as 185, an upper end of which is defined by the packer mandrel assembly 50 and a lower end of which is defined by the rotating case assembly 156 so that upward forces can be transferred from the rotating case assembly 156 to the packer mandrel assembly 50 by compression of the oil contained in the sealed chamber 184.

The use of a sealed oil field chamber to provide the thrust bearing means 185 is particularly useful in the drill pipe bridge plug apparatus 48 which necessarily is a relatively narrow tool since it must be received in the inner bore of a conventional string of drill pipe. Thus the radial thickness 192 (see FIG. 3C) of the components which define the thrust bearing means 184 is relatively small on the order of 1.063 inch, which is not suitable for typical mechanical type thrust bearings.

The thrust bearing mean 185 will permit rotation of the rotating case assembly 156 relative to the packer mandrel assembly 50 while simultaneously applying a sufficient upward force o the packer mandrel assembly 50 from the rotating case assembly 156 to maintain the packer means 108 sealed against the drill pipe bore 28.

The threaded mandrel 162 of rotating case assembly 156 includes an elongated internal thread 194 adjacent its lower end which is threadedly engaged with the external thread 150 of bypass sleeve mandrel 136.

Thus, after the packer means 108 has been set within the bore 28 of drill pipe string 16, the bypass port 56 can be closed by rotating the rotating case assembly 156 clockwise (as viewed from above) with the work string 46 so that the engagement between threads 150 and 194 will pull the bypass sleeve assembly 134 upward relative to packer mandrel assembly 50 so that the bypass sleeve 138 will close the bypass port 56. The bypass port 56 can subsequently be reopened by rotating the rotating case assembly 156 counterclockwise to move the bypass sleeve assembly 134 back downward to its open position.

The bridge plug apparatus 48 further includes an overshot assembly 196 which is releasably connectable to the retrieving mandrel 158.

Overshot assembly 196 includes an overshot adapter 198 and an overshot 200 which are threadedly connected at connection 202 with a set screw 204 locking the same and with an O-ring seal 206 therebetween.

The overshot adapter 198 has an internal thread 208 adjacent its upper end for connection thereof to the work string 46 of FIG. 2.

Overshot 200 includes a radially inward projecting lug 210 which is received in a J-slot 212 defined in the outer surface of retrieving mandrel 158. The lug 210 and J-slot 212 are best seen in the laid out view of FIG. 4. The J-slot 212 includes a longer downwardly tapered leg 214 having an open upper end 216 defined at the upper end 218 of retrieving mandrel 158. J-slot 212 also includes an enclosed shorter leg 220.

Figure 4:
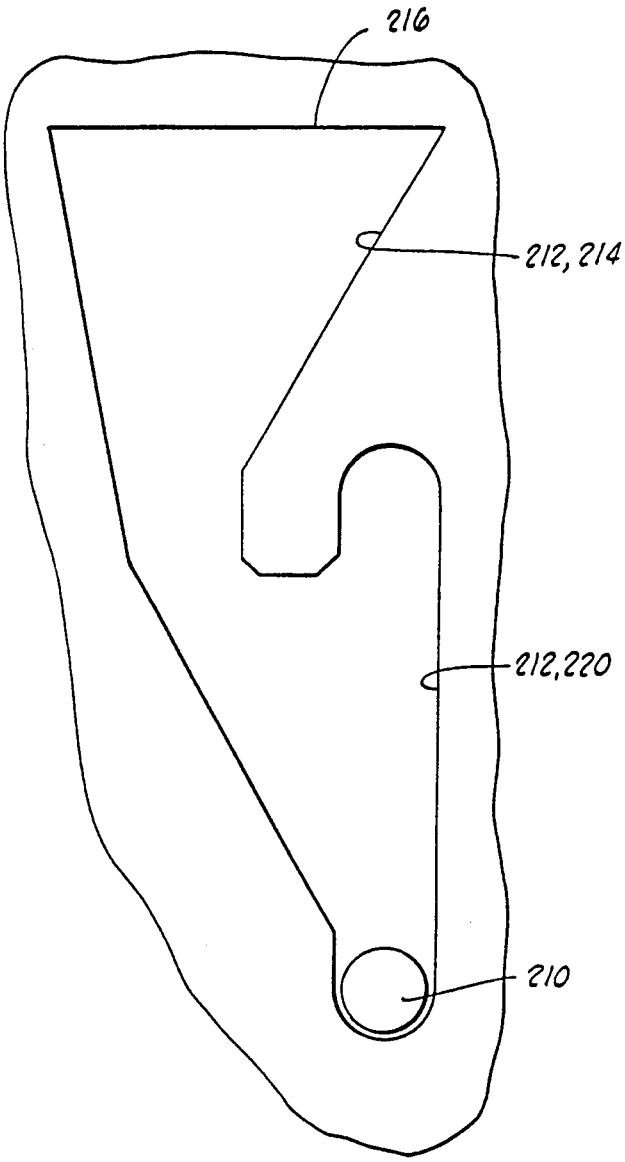
FIG. 4 is a laid out view of the upper J-slot of FIG. 3B which connects the overshot to the rotating case assembly.

The overshot assembly 196 and the retrieving mandrel 158 are releasably connected together when the lug 210 is contained in the enclosed shorter leg 220 of J-slot 212 as shown in FIGS. 3B and 4. After the bridge plug apparatus 48 has been set in place in the drill pipe string 16 as schematically illustrated in FIG. 2, the overshot assembly can be disconnected therefrom by lowering the work string to move the lug 210 to the position shown in FIGS. 3B and 4, then rotating the work string 46 clockwise (as viewed from above) and pulling the work string 46 upward to move the lug 210 through the longer leg 214 and out the open upper end 216 thereof.

The packer mandrel assembly 50 having its mandrel bore 52, barrier 54 and bypass port 56 defined therein, along with the bypass sleeve assembly 134, the rotating case assembly 156, and the thrust bearing means 185 can collectively be referred to as a selectively positionable bypass means which can accomplish a multitude of functions within the bridge plug apparatus 48. First, this selectively positionable bypass means prevents fillup of the work string 46 as the work string 46 and attached bridge plug apparatus 48 are run into position in the drill pipe string 16. Second, this selectively positionable bypass means provides a means for communicating the pipe bore 28 below the packer means 108 with a low pressure zone, e.g., annulus 154, above the packer means 108 through the mandrel bore 5 prior to sealing the sealing element 132 of packer means 108 against the pipe bore 28. Third, this selectively positionable bypass means provides a means for isolating the pipe bore 28 below the packer means 108 from the low pressure zone 154 above the packer means 108 after the sealing element 132 of packer means 108 is sealed against the pipe bore 28. Fourth, this selectively positionable bypass means provides a means for recommunicating the pipe bore 28 below the packer means 108 with the low pressure zone 154 above the packer means 108 through the mandrel bore 52 to balance pressure across the sealing element 132 of packer means 108 prior to unsetting the packer means 108.

Alternative Embodiment Of FIGS. 6A-6K

In FIGS. 6A-6K, a modified version of the bridge plug apparatus 48 is shown and generally designated by the numeral 222. Most of the components of bridge plug apparatus 222 are near identical to components of bridge plug apparatus 48, and those components have been given identical identifying numbers in the drawings.

The primary difference between bridge plug apparatus 222 of FIGS. 6A-6K and the bridge plug apparatus 48 of FIGS. 3A-3J, is that the alternative bridge plug apparatus 222 is designed to bypass fluid from below the packer 108 into the interior of the work string 46, rather than into the annulus 154.

The bridge plug apparatus 222 has been modified in three locations as compared to the apparatus 48.

Figure 6A:
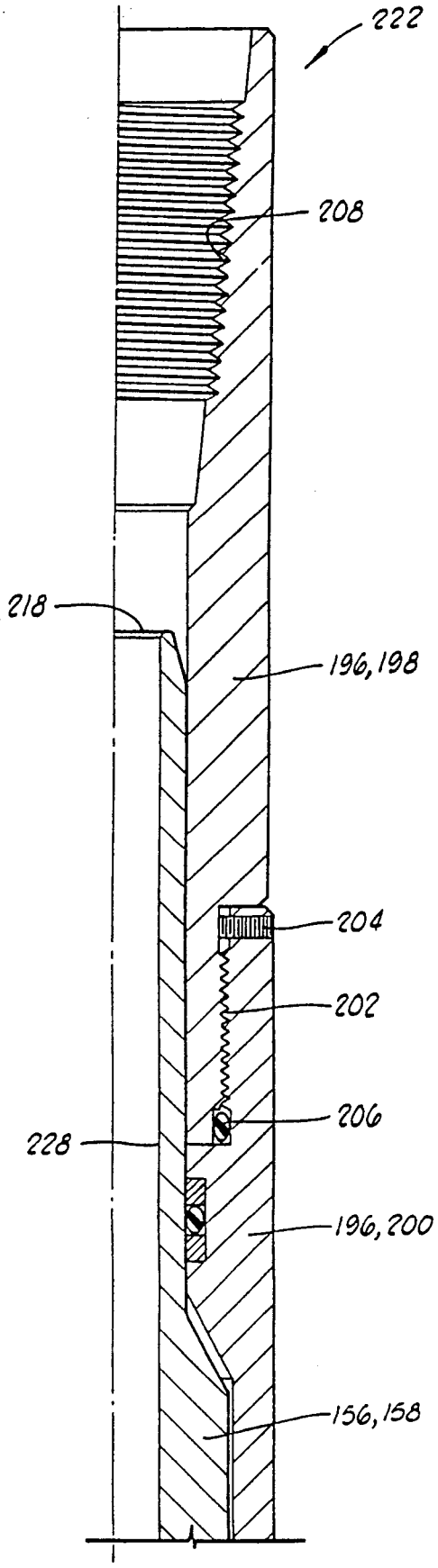
FIGS. 6A–6K comprises an elevation right side only sectioned view of an alternative embodiment of the bridge plug apparatus of the present invention. In the embodiment of FIGS. 6A–6K the bypass means is shown in FIG. 6E in an open position, and bypasses fluid up into the interior of the snubbing unit work string.
Figure 6B:
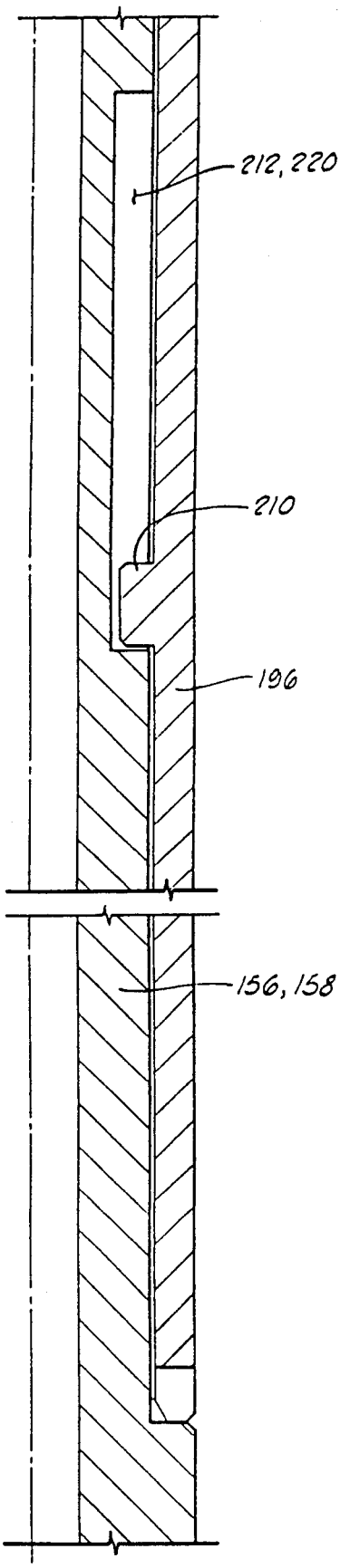
Figure 6C:
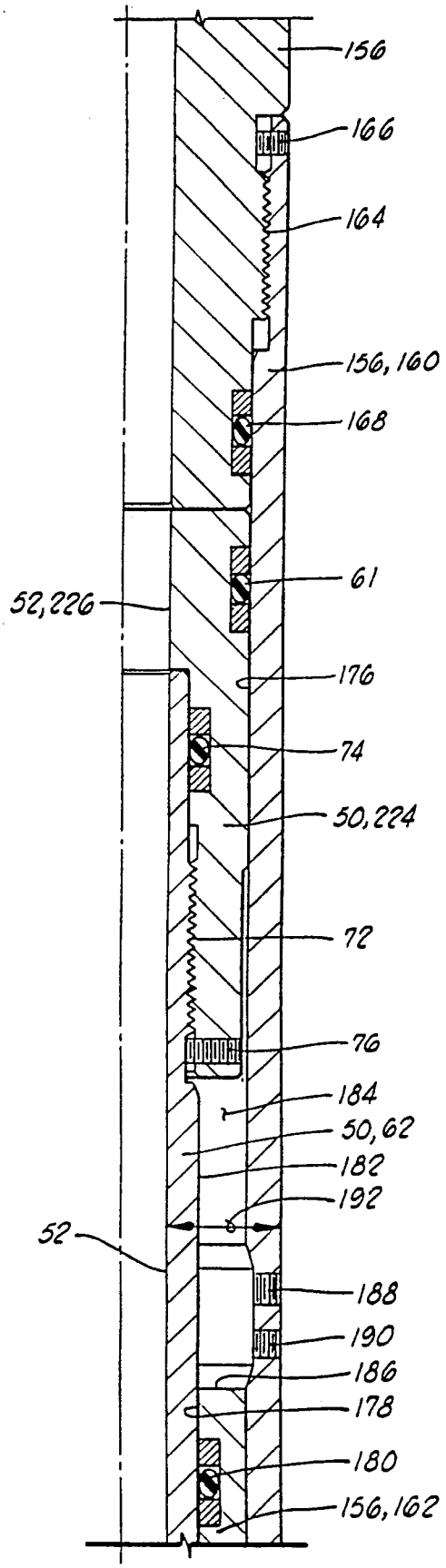
Figure 6D:
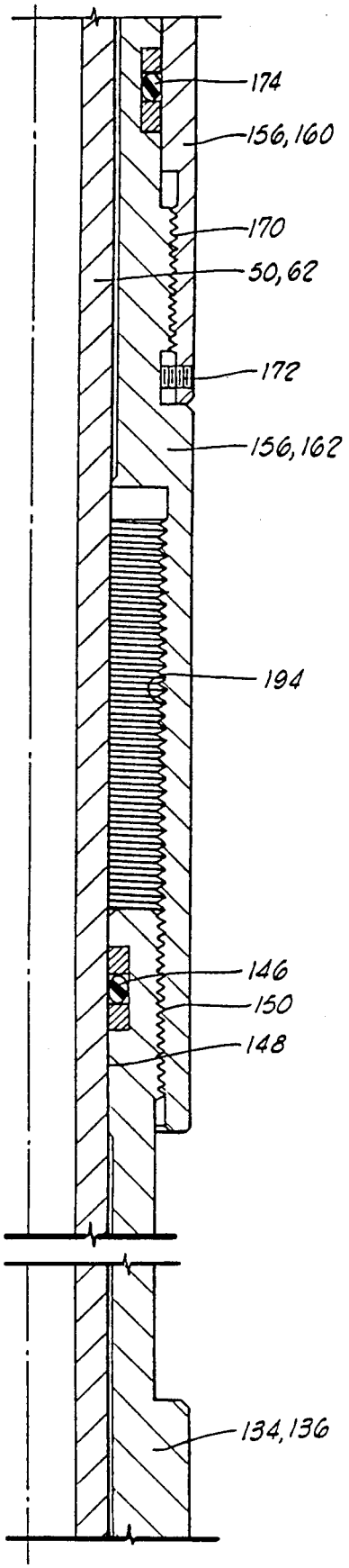

First, the differential piston 60 of FIG. 3C has been replaced with a modified differential piston 224 in FIG. 6C having an open bore 226 therethrough so that the longitudinal bore 52 of the packer mandrel assembly 50 of the modified bridge plug 222 is communicated through a bore 228 of retrieving mandrel 158 with the interior of the work string 46.

Figure 6E:
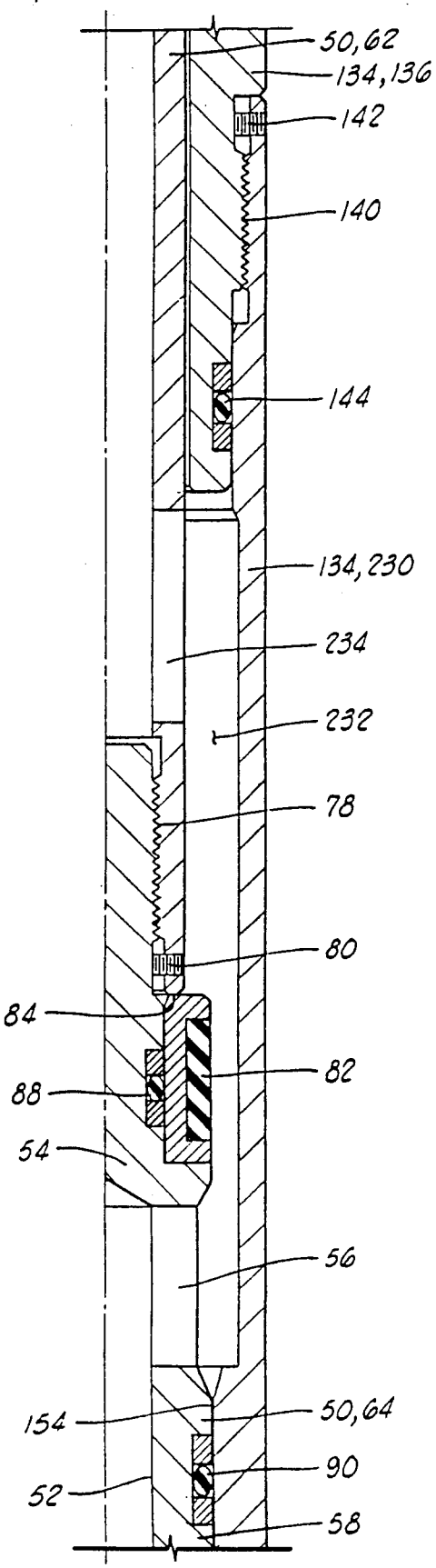
Figure 6F:
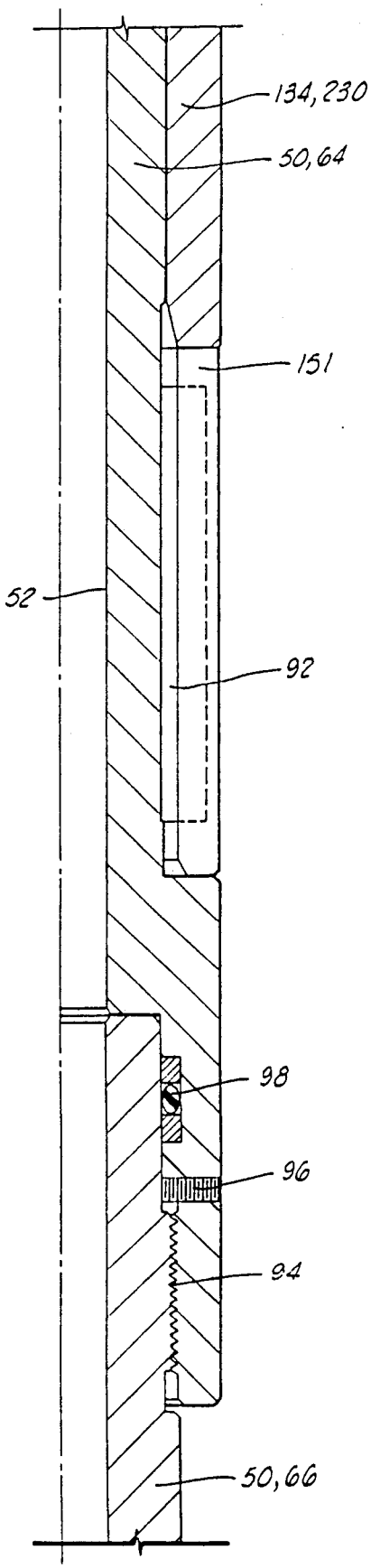
Figure 6G:
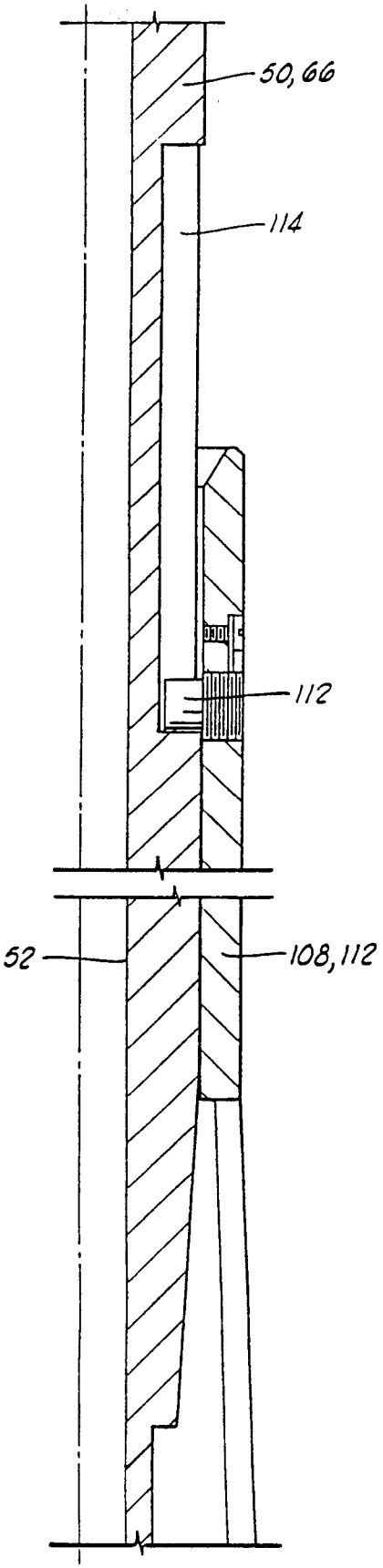
Figure 6H:
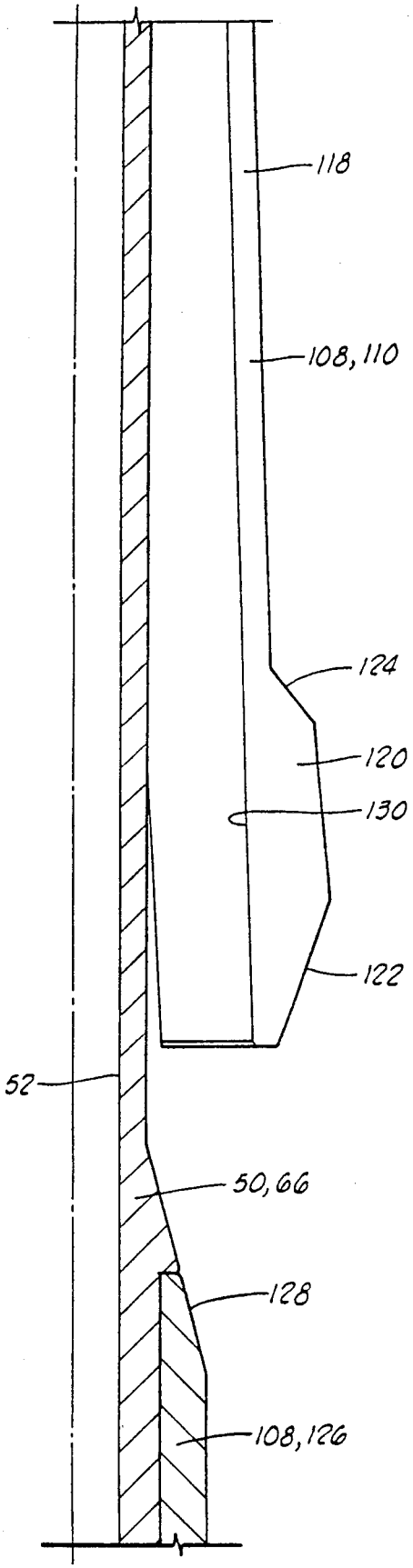
Figure 6I:
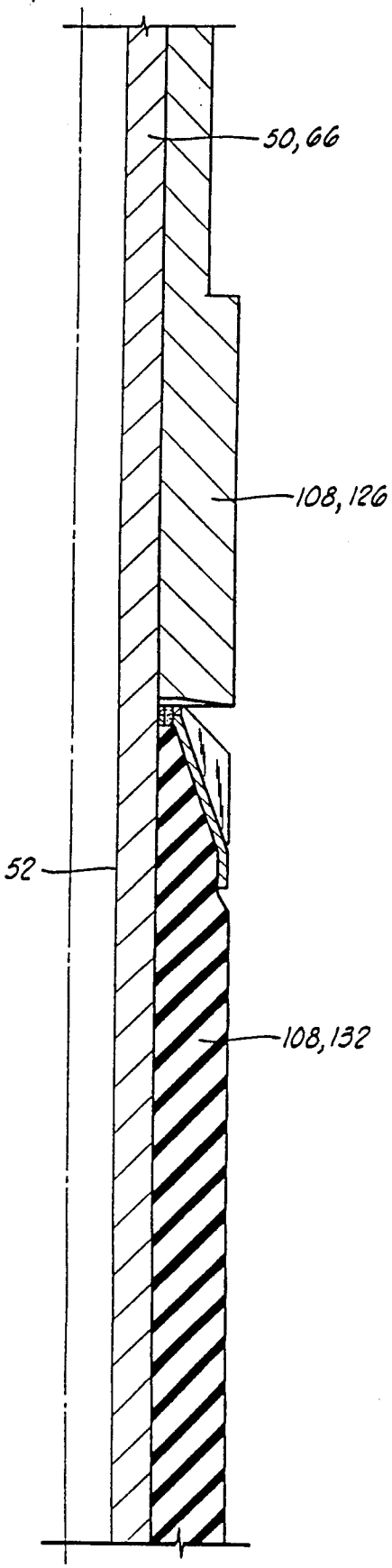
Figure 6J:
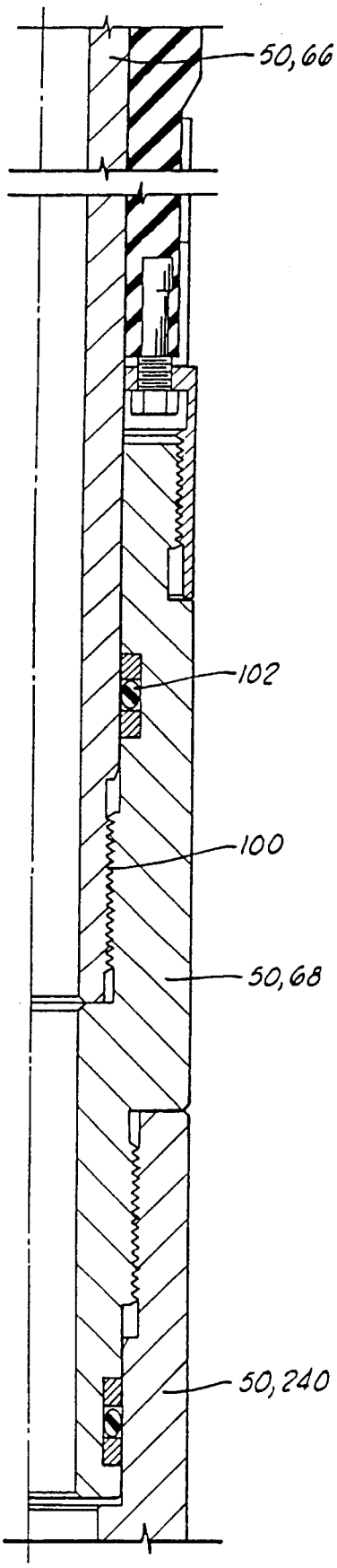
Figure 6K:
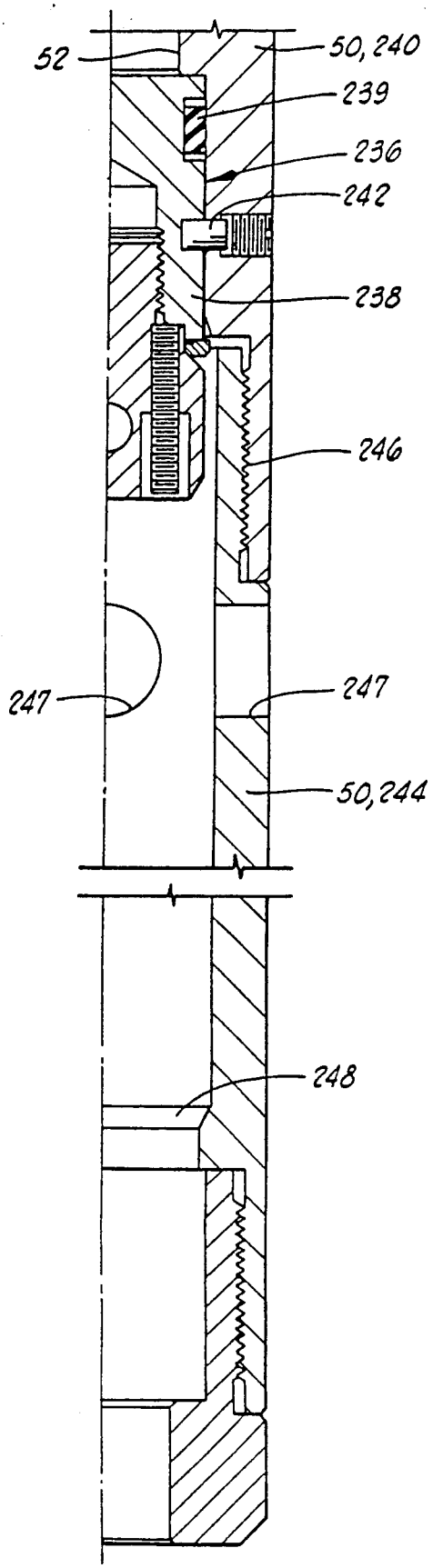

Second, the bypass sleeve 138 of FIG. 3E has been replaced with a modified bypass sleeve 230 in FIG. 6E. The modified bypass sleeve 230 does not have a sleeve port such as port 152 of FIG. 3E. Instead, the modified bypass sleeve 230 defines an annular bypass passage 232 which communicates with an upper bypass port 234 defined through the wall of upper mandrel 62 and communicating with an upper portion of the mandrel bore 52 defined within upper mandrel 62. Thus, when the bypass sleeve 230 of the modified bridge plug apparatus 222 is in its open position as illustrated in FIG. 6E, the upper and lower portions of mandrel bore 52 above and below the barrier 54, respectively, are communicated with each other through the bypass passage 232 and the upper and lower bypass ports 234 and 56.

The third modification to the bridge plug apparatus 222 is the addition to the lower portion thereof of a releasable closure plug means 236 for initially blocking flow of well fluid up through mandrel bore 52 as the bridge plug apparatus 222 is lowered with the work string 46 into the drill pipe string 16.

The releasable closure plug means 236 includes a closure plug 238 closely received in a plug housing extension 240 of packer mandrel assembly 50. An annular seal 239 seals between closure plug 238 and plug housing extension 240.

A releasable attachment means 242, which is preferably a shear pin 242, provides a means for initially retaining the closure plug 238 in place within the mandrel bore 52, and for subsequently releasing the closure plug 238 so that the closure plug 238 can be pumped downward to place the mandrel bore 52 below barrier 54 in communication with the pipe bore 28 of drill pipe string 16 below the packer means 108.

The modified packer mandrel assembly 50 further includes a basket means 244 connected to plug housing extension 240 at threaded connection 246. The basket means 244 provides a means for catching the closure plug 238 when it is pumped out of engagement with plug housing extension 240.

The basket means 244 has a plurality of radial ports 247 through a wall thereof. When the closure plug 238 drops out of housing extension 240 it will be caught by a reduced diameter annular ledge 248 below the ports 247 so that the bore 28 of drill pipe string 16 is communicated through the ports 247 and up through the mandrel bore 52 to the lower bypass port 56.

Manner Of Operation

Methods of utilizing the apparatus 48 and 222 just described in order to control flow up through the drill pipe 16 of a well 10 that is flowing out of control are as follows.

The well 10 will initially be in a condition like that generally described above with regard to FIG. 1. An upper end 24 of the drill pipe string 16 is damaged, and well fluids are flowing upwardly therethrough. It is necessary to remove the damaged portions at the upper end of the drill pipe string 16 and reconnect new drill pipe segments to the undamaged portion of the drill pipe string before the well 10 can be brought completely under control.

The repair of the damaged drill pipe string is accomplished in part by lowering the bridge plug apparatus 48 or 222 on the work string 46 through the snubbing unit 44 down into the bore 28 of drill pipe string 16 to a position where the drill pipe bore 28 is desirably closed, i.e., within one of the undamaged joints of drill pipe.

As the bridge plug apparatus 48 or 222 is being lowered into the pipe bore 28, it is desirable to prevent fluid which is flowing u through the drill pipe string 16 from flowing into the work string 46. With the bridge plug apparatus 48, the differential piston 60 provides a barrier across the bore of the bridge plug apparatus thus preventing the work string 46 from filling up. With the bridge plug apparatus 222, the closure plug means 236 prevents fluid from flowing upward through the bridge plug apparatus 222 and into the work string 46.

Once the bridge plug 48 or 222 is positioned near the location where it is desired to block the drill pipe bore 28, the bore 28 below packer means 108 should be communicated through mandrel bore 52 with a low pressure zone above packer means 108 so that the upward flow of fluid does not interfere with the setting of packer means 108. With bridge plug 48 this is accomplished by having sleeve 138 in the open position of FIG. 3E so that well fluid flows into annulus 154. If the alternative bridge plug apparatus 222 is being utilized, pressure must be applied to the interior of the work string 46 to pump the closure plug 238 out of sealing engagement with plug housing extension and down into the basket 244 thus permitting well fluid to flow through mandrel bore 52 up into work string 46.

Next packer means 108 must be set. The work string is lowered and rotated counterclockwise (as viewed from above), then picked back up to manipulate the lug 112 into the longer leg 116 of J-slot 114 and to allow the collet 110 to drop down into engagement with the annular anchoring wedge 126. Then, the work string 46 and bridge plug apparatus 48 or 222 is raised so that the engaging shoulders 124 of arms 118 of collet 110 will engage the internal upset 36 of the drill pipe bore 28 thus preventing any further upward movement of the collet 108 and annular wedge 126. Applying a continued and increasing upward pull to the work string 46 pulls the packer mandrel 66 upward relative to the anchor ring 126 thus compressing and expanding radially outward the packer sealing element 132 so that the same seals against the larger diameter portion 40 of pipe bore 28 a schematically illustrated in FIG. 2.

After the bridge plug apparatus 48 or 222 has been set and sealed against the pipe bore 28, it is then necessary to isolate the pipe bore 28 below the sealing element 132 from the low pressure zone thereabove, i.e., either annulus 154 or the interior of work string 46, to thereby stop the flow of well fluids up through the drill pipe string 16. This is accomplished by rotating the work string 46 clockwise (as viewed from above) through a sufficient number of turns to move the sleeve valve assembly 134 upwards along threaded connection 150, 194 thus closing the bypass port 56. Sufficient upward pull must be maintained on the packer means 108 to hold the same set against the internal upset 36 while the bypass port 56 is being closed.

After the bypass port 56 has been closed, the work string 46 may be disconnected from the bridge plug apparatus 48 or 222 by lowering the work string 46, rotating the same clockwise (as viewed from above), then lifting the work string 46 upward to move the lug 210 up through the open ended longer leg 214 of J-slot 212.

After the work string 46 is disconnected from bridge plug apparatus 48 or 222, the bridge plug apparatus is maintained in engagement with the internal upset 36 and sealed against the drill pipe bore 28 due to an upward pressure differential applied to the bridge plug apparatus by the pressurized well fluids contained in the drill pipe string 16 below the bridge plug apparatus.

After the work string 46 has been removed, the damaged upper portions of the drill pipe string 16 above the bridge plug apparatus can be removed without interference from fluids flowing upward therethrough. Subsequently, new sections of drill pipe can be added to those remaining in the well.

Then, the bridge plug apparatus 48 or 222 can be retrieved by running the work string 46 with the overshot assembly 196 attached thereto back into the well, reengaging the lug 210 within the J-slot 212, then rotating the work string 46 counterclockwise (as viewed from above) to move the bypass sleeve assembly 134 back to an open position so that the drill pipe bore 28 below packer means 108 is recommunicated with the low pressure zone above the packer means 108 to relieve the upward pressure differential acting across the bridge plug apparatus 48 or 222. This is preferably accomplished with an upward pull being applied to the work string 46 and the bridge plug apparatus 48 as the work string 46 is rotated to reopen the bypass port 56.

After pressure has been balanced across to packer means 108 weight is set down on the work string 46 thereby unseating the packer means 108 from the pipe bore 28. The work string 46 is manipulated so as to move the collet 108 back to its upper position as illustrated in FIG. 3G. Then, the bridge plug apparatus 48 or 222 can be retrieved from the drill pipe string 16 by removing the work string 46 and the bridge plug apparatus from the pipe string 16.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of the invention may be made by those skilled in the art which changes are encompassed within the scope and spirit of the present invention as defined by the appended claims.

What is claimed is:

1. A method of stopping flow of fluid up through a pipe bore of a pipe string in a well, said method comprising the steps of:

(a) lowering a bridge plug apparatus on a work string into said pipe string to a position where said pipe bore is to be closed;

(b) communicating said pipe bore below a packer of said bridge plug apparatus through said bridge plug apparatus with a low pressure zone above said packer to permit said fluid to flow up through said bridge plug apparatus;

(c) engaging said bridge plug apparatus with an internal upset of said pipe string;

(d) while said fluid is flowing up through said bridge plug apparatus, pulling upward on said work string and said bridge plug apparatus and thereby sealing said packer against said pipe bore;

(e) after step (d), isolating said pipe bore below said packer from said low pressure zone above said packer and thereby stopping flow of said fluid up through said pipe bore;

(f) after step (e), disconnecting said work string from said bridge plug apparatus; and (g) after step (f), maintaining said bridge plug apparatus in engagement with said internal upset and sealed against said pipe bore due to an upward pressure differential applied to said bridge plug apparatus by the fluid contained therebelow.

2. The method of claim 1, further comprising:

during step (a), preventing fill-up of said work string with said fluid.

3. The method of claim 1 wherein:

step (b) is further characterized in that said low pressure zone is an annulus between said work string and said pipe string.

4. The method of claim 1 further comprising:

(h) re-connecting said work string to said bridge plug apparatus;

(i) re-communicating said pipe bore below said packer with said low pressure zone to relieve said upward pressure differential;

(j) setting down said work string and thereby unseating said packer from said pipe bore; and (k) retrieving said bridge plug apparatus from said pipe string.

5. The method of claim 4 wherein step (i) is accomplished by rotating said work string.

6. The method of claim 1 wherein step (e) is accomplished by rotating said work string

7. The method of claim 1 wherein step (b) is accomplished by pumping a closure plug out of a bore of said bridge plug apparatus.

8. The method of claim 1 wherein step (e) is accomplished while maintaining a sufficient upward pull on said bridge plug apparatus with said work string to hold said bridge plug apparatus in engagement with said internal upset with said packer sealed against said pipe bore.

9. The method of claim 8 wherein step (e) is accomplished by rotating said work string.

10. The method of claim 9 wherein said step of maintaining a sufficient upward pull on said bridge plug apparatus during step (e) is accomplished by transferring the upward pull of said work string to said bridge plug apparatus through compression of a liquid contained in a sealed chamber of a rotatable thrust bearing assembly.

* * * * *

UNITED STATES PATENT AND TRADEMARK OFFICE

CERTIFICATE OF CORRECTION

PATENT NO. : 5,058,684
DATED : October 22, 1991
INVENTOR(S) : Donald W. Winslow et al.

It is certified that error appears in the above-indentified patent and that said Letters Patent is hereby corrected as shown below:

In column 2, line 54, after the word "side" insert therefor --only--.

In Column 4, line 57, delete the numeral [5] and insert therefor --50--.

In column 9, line 52, delete the letter [u] and insert therefor --up--.

Signed and Sealed this

Twenty-third Day of January, 1996

Bruce Lehman

*Attest:*

BRUCE LEHMAN

*Attesting Officer*

*Commissioner of Patents and Trademarks*